US008986134B2

(12) United States Patent
Stites et al.

(10) Patent No.: US 8,986,134 B2
(45) Date of Patent: Mar. 24, 2015

(54) GOLF CLUB AND GOLF CLUB HEAD WITH AN INSERT-RECEIVING FEATURE

(71) Applicant: Nike, Inc., Beaverton, OR (US)

(72) Inventors: John T. Stites, Weatherford, TX (US); Robert Boyd, Flower Mound, TX (US)

(73) Assignee: Nike, Inc., Beaverton, OR (US)

( * ) Notice: Subject to any disclaimer, the term of this patent is extended or adjusted under 35 U.S.C. 154(b) by 2 days.

(21) Appl. No.: 13/905,769

(22) Filed: May 30, 2013

(65) Prior Publication Data

US 2013/0337938 A1 Dec. 19, 2013

Related U.S. Application Data

(60) Provisional application No. 61/654,074, filed on May 31, 2012.

(51) Int. Cl.
*A63B 53/06* (2006.01)
*A63B 53/04* (2006.01)

(52) U.S. Cl.
CPC ..... *A63B 53/06* (2013.01); *A63B 53/0466* (2013.01); *A63B 2053/0491* (2013.01); *A63B 2209/00* (2013.01); *A63B 2209/10* (2013.01); *A63B 2225/01* (2013.01); *A63B 2053/0433* (2013.01)
USPC ..... 473/334; 473/341; 473/344

(58) Field of Classification Search
CPC ..... A63B 53/06; A63B 2053/0433; A63B 2053/0491
USPC ..... 473/334, 338, 336, 341, 344
See application file for complete search history.

(56) References Cited

U.S. PATENT DOCUMENTS

| | | | | |
|---|---|---|---|---|
| 7,993,216 | B2 * | 8/2011 | Lee | 473/334 |
| 8,246,488 | B2 * | 8/2012 | Stevens et al. | 473/335 |
| 8,753,225 | B1 * | 6/2014 | Abbott et al. | 473/334 |
| 2006/0172821 | A1 | 8/2006 | Evans | |
| 2008/0171612 | A1 | 7/2008 | Serrano et al. | |
| 2012/0083359 | A1 | 4/2012 | Stites | |
| 2013/0178305 | A1 * | 7/2013 | Beno et al. | 473/287 |

OTHER PUBLICATIONS

International Searching Authority, "International Search Report and Written Opinion," issued in connection with international application serial No. PCT/US2013/043331, mailed Aug. 20, 2013, 9 pages.

* cited by examiner

*Primary Examiner* — Benjamin Layno
(74) *Attorney, Agent, or Firm* — Banner & Witcoff, Ltd.

(57) ABSTRACT

A golf club includes a shaft and a club head for a metal wood type club. The club head includes a ball striking face, a heel, a toe, a rear, a crown, a sole and a centerline extending from the ball striking face to the rear. The sole includes a substantially horizontally-oriented sole surface extending rearwardly from the ball striking face to the rear. A first insert-receiving feature is located to a heel-side of the centerline, and a second insert-receiving feature is located to a toe-side of the centerline. The first and second insert-receiving features are substantially symmetrically located with respect to the centerline. The first and second insert-receiving features have substantially mirror-images shapes with respect to the centerline. A system having a golf club head with an insert-receiving feature and multiple interchangeable inserts configured for being received within the insert-receiving feature is also provided.

26 Claims, 7 Drawing Sheets

GOLF CLUB AND GOLF CLUB HEAD WITH AN INSERT-RECEIVING FEATURE

RELATED APPLICATIONS

This application claims the benefit of priority of U.S. Provisional Application No. 61/654,074, filed May 31, 2012, the contents of which are hereby incorporated by reference in its entirety.

FIELD

Aspects of this invention relate generally to golf clubs and golf club heads, and, in particular, to golf clubs and golf club heads having insert-receiving features, thereby creating a system for customizing the weight distribution of the club head.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Altering the moment of inertia can also affect how the golf club performs including how the golf club head design impacts heel and toe mishits. Similarly, other factors such as point of impact and launch angle can also affect how the ball travels once it has been struck.

Club designers are often looking for new ways to redistribute weight associated with a golf club and/or golf club head. For instance, club designers are often looking to distribute weight to provide more forgiveness in a club head, improved accuracy, and the like.

In a customizable club system many different combinations of elements (i.e., shafts, heads, head components, etc.) could be selected and permanently attached to one another to form the ultimate club. However, when buying a golf club, most golfers want to try out the actual, customized club that they will eventually use. To achieve a true feel for the club, the customizable components must be attached to one another as they would be under actual playing conditions. Thus, if a combination of elements is selected and the elements are permanently attached to each other to form the club (as they would be under actual playing conditions, so at to achieve a true feel for the club), but ultimately not chosen by the golfer, this customized and permanently assembled golf club could languish in the shop, possibly never being selected by any golfer. It would be desirable to have a more versatile component assembly system, whereby one could freely attach and then detach the different club elements from one another to try out a variety of club configurations, while at the same time achieving a true feel for the club. This would allow golfers to freely try many different combinations until the best combination for a particular golfer is achieved.

Further, it is possible that an individual golfer's swing style could improve or otherwise vary over time. In such case, a club customized to the golfer's earlier swing style may no longer be appropriate. It is also possible that, after a few initial rounds, the golfer may determine that the customized club does not accommodate his swing as much as would be desired. Even further, new technology or fashions may appear and a golfer may wish to keep current with the latest. A club having detachable elements would allow the golfer to replace the elements and modify or upgrade the club as desired.

It is an object of the present invention to provide a golf club head system that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

At least some aspects of the disclosure relate to golf clubs and golf club heads having insert-receiving features formed in the sole of the golf club head.

In accordance with certain aspects, a golf club includes a shaft and a club head secured to a distal end of the shaft. A golf club head for a metal wood type club may include a ball striking face, a heel, a toe, a rear, a crown and a sole. The club head may define a top-to-bottom height, a front-to-back breadth, and a side-to-side length. Further, the club head may define a centerline extending from the ball striking face to the rear of the club head.

According to some aspects, a sole of the golf club head includes a substantially horizontally-oriented sole surface extending rearwardly from the ball striking face to the rear. A first insert-receiving feature is located to a heel-side of the centerline. A second insert-receiving feature is located to a toe-side of the centerline. The first and second insert-receiving features are substantially symmetrically located with respect to the centerline. The first and second insert-receiving features have substantially mirror-images shapes with respect to the centerline.

According to other aspects, a golf club system having a golf club head with an insert-receiving feature and multiple interchangeable inserts configured for being received within the insert-receiving feature is provided. In other words, a first insert may be detachably attached to the sole, and at least one other insert may be attachably interchangeable with the first insert. In this system, each insert may have a unique or different combination of mass, center-of-gravity and/or moment-of-inertia characteristics and/or each insert may have a unique or different external shape and/or surface texture.

According to certain aspects, the sole of a golf club head for a metal wood type club, includes a forward sole surface located adjacent the ball striking face and a central sole surface having first and second central sole surface edges extending rearwardly from the forward sole surface. The central sole surface may be approximately centered over the centerline of the club head. A first insert-receiving feature may be located to one of a heel-side or a toe-side of the central sole surface, wherein an edge of the first insert-receiving feature forms at least a portion of the first central sole surface edge. A first insert may be detachably positioned within the first insert-receiving feature.

In accordance with even further aspects, a system for a golf club head for a metal wood type club is provided. The system includes a golf club head having a ball striking face, a heel, a toe, a rear, a crown and a sole. The club head has a centerline extending from the ball striking face to the rear. The sole includes a substantially horizontally-oriented sole surface extending rearwardly from the ball striking face to the rear. A first insert-receiving feature is located to a heel-side of the centerline. A second insert-receiving feature is located to a toe-side of the centerline. The first and second insert-receiving features may be substantially symmetrically located with respect to the centerline. The first and second insert-receiving features may have substantially mirror-images shapes with respect to the centerline. Further, the system may include a first plurality of inserts configured for interchangeable attachment within the first insert-receiving feature. The inserts of the first plurality of inserts have masses that differ. A second plurality of inserts configured for interchangeable attachment within the second insert-receiving feature may also be provided. The inserts of the second plurality of inserts may have masses that differ.

Thus, a golf club head system may include two or more inserts, each configured for interchangeable attachment to a sole. Each insert may have a unique or different combination of center-of-gravity and moment-of-inertia characteristics. A means for detachably attaching each insert, interchangeably, to the sole may be provided. The system may be supplied as a kit.

These and additional features and advantages disclosed here will be further understood from the following detailed disclosure of certain embodiments.

Figure 1B:
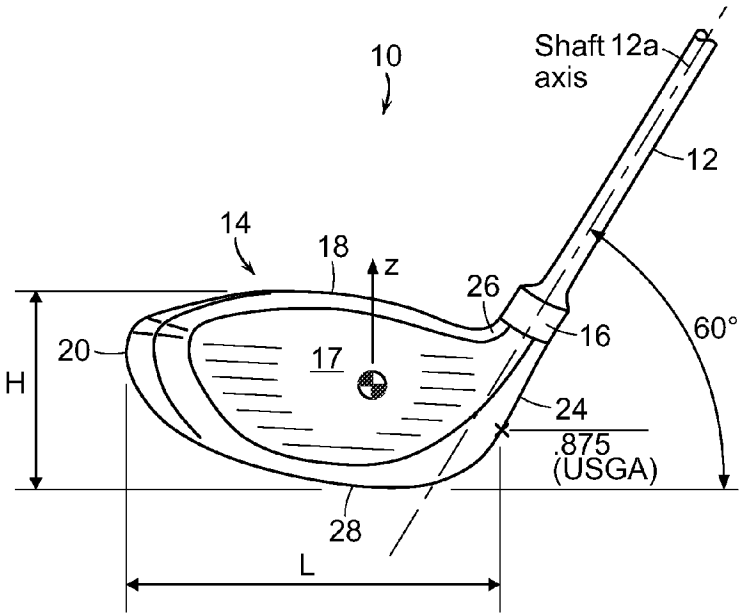
FIG. 1B is a schematic front view of a golf club illustrating certain parameters.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention.

The invention generally will be described as it relates to wood-type golf clubs. However, aspects of the invention may be used with any of several types of golf clubs, including hybrid type golf clubs, utility clubs, and the like and nothing in the specification or figures should be construed to limit the invention to use with the wood-type golf clubs described. Thus, a wide variety of overall club head constructions are possible without departing from this invention.

Further, if desired, some or all of the various individual parts of the club heads described below may be made from multiple pieces that are connected together (e.g., by welding, adhesives, or other fusing techniques; by mechanical connectors; etc.). The various parts (e.g., crown, sole, ball striking face, rear, etc.) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. The various parts of the club head may be formed of one or more composite materials. The club head and/or portions of the club head also may be made by forging, casting, molding or other desired processes, including club head forming processes as are conventionally known and used in the art.

Unless otherwise disclosed herein, the various individual parts that make up a club head structure, if made from multiple pieces, may be engaged with one another and/or held together in any suitable or desired manner, including in conventional manners known and used in the art. For example, the various parts of the club head structure, such as the ball striking face, the crown, the sole, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure together.

The dimensions and/or other characteristics of a golf club head structure according to examples of this invention may vary significantly without departing from the invention, and the dimensions may be consistent with those commonly used in the art for similar club heads and clubs.

Figure 1A:
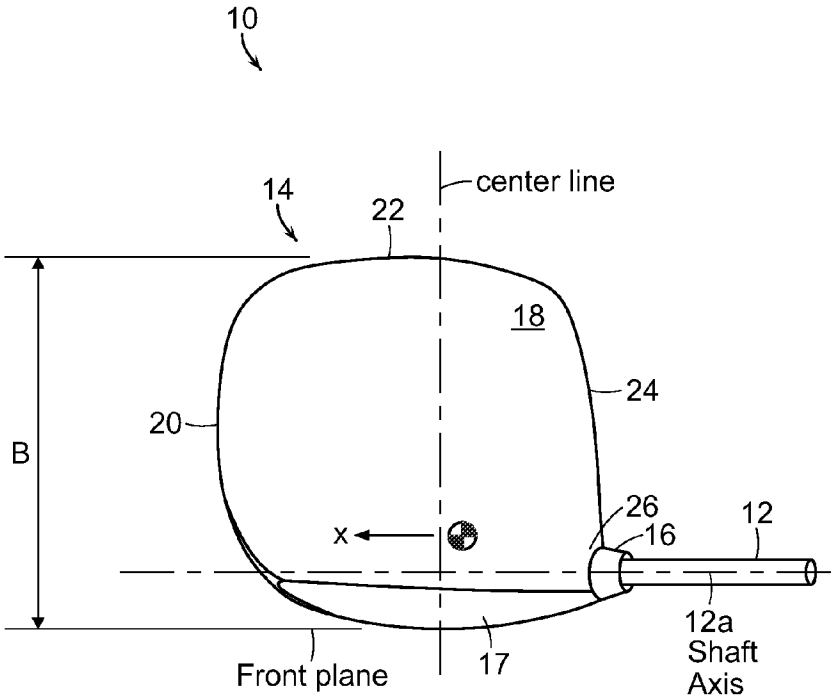
FIG. 1A is a schematic top plan view of a golf club illustrating certain parameters.

For purposes of this disclosure, and referring to FIGS. 1A and 1B, with a club head positioned at a 60-degree lie angle as defined by the USGA (see USGA, "Procedure for Measuring the Club Head Size of Wood Clubs"), the "centerline" (C) of the club head coincides with the indicator on the face squaring gauge when the face squaring gauge reads zero for clubs having a neutral face angle. The length (L) of the club head extends from the outermost point of the toe to the outermost point of the heel, as defined by the above-referenced USGA procedure. The breadth (B) of the club head extends from the outermost point of the face to the outermost point of the rear. Similar to the procedure for determining the outermost point of the toe (but now turned 90 degrees), the outermost points of the face and rear may be defined as the points of contact between the club head in the USGA 60-degree lie angle position with a vertical plate running parallel to the longitudinal axis of the shaft. The vertical plane associated with this measurement of the outermost point of the face may be referred to as the "front plane" of the club head. The height (H) of the club head extends from the uppermost point of the crown to the lowermost point of the sole, as defined by the above-referenced USGA procedure. The terms "above," "below," "upper," "lower," "top," "bottom," "front," "back," "rear," "side," "heel-side," "toe-side," etc. all may refer to views associated with the club head when it is positioned at this USGA 60-degree lie angle.

For purposes of this disclosure, "length" measurements or dimensions are taken parallel to the front plane of the club head and parallel to the ground. "Breadth" measurements or dimensions are taken parallel to the centerline of the club head and parallel to the ground. "Height" measurements or dimensions are taken parallel to a vertical plane when the club head is in its 60-degree lie angle position. Dimensions or measurements for a given region or surface are usually defined between transition points unless otherwise noted. A transition point is where a surface or region transitions from a vertical to a horizontal orientation or from a lengthwise to a breadthwise orientation. In the absence of a corner, a transition point may generally be defined as having a tangent at a 45 degree angle from the horizontal (or vertical) or a tangent at a 45 degree angle from the front plane (or centerline).

Still referring to FIGS. 1A and 1B, a golf club 10 having a golf club head 14 attached to a shaft 12 is shown schematically in order to illustrate certain general features. The golf club head 14 may be a driver, as shown. Club head 14 has a body that includes a hosel or socket 16 configured for receiving the shaft 12. The body of club head 14 may include a plurality of portions, regions or surfaces, such as a ball striking face 17, a crown 18, a toe 20, a rear 22, a heel 24, a hosel region 26 and a sole 28. For certain club heads, the body may include one or more cavities and/or may be substantially hollow.

Ball striking face 17 may be essentially flat or it may have a slight curvature or bow (for example, a "bulge" and/or a "roll"). Although the golf ball may contact ball striking face 17 at any spot on the face, the desired-point-of-contact of ball striking face 17 with the golf ball is typically approximately centered within ball striking face 17.

Crown 18, which is located on the upper or top side of club head 14, extends from ball striking face 17 back toward rear 22 of golf club head 14. When club head 14 is viewed from below, crown 18 cannot be seen.

Sole 28, which is located on the lower or ground side of club head 14 opposite to crown 18, extends from ball striking face 17 back toward rear 22. As with crown 18, sole 28 extends across the width of club head 14, from heel 24 to toe 20. When club head 14 is viewed from above, sole 28 cannot be seen.

Rear 22 is positioned opposite ball striking face 17, is located between crown 18 and sole 28, and extends from heel 24 to toe 20. When club head 14 is viewed from the front, rear 22 cannot be seen.

Heel 24 extends from ball striking face 17 to rear 22. When club head 14 is viewed from the toe-side, heel 24 cannot be seen.

Toe 20 is shown as extending from ball striking face 17 to rear 22 on the side of club head 14 opposite to heel 24. When club head 14 is viewed from the heel-side, toe 20 cannot be seen.

Socket 16 for attaching shaft 12 to club head 14 is located within hosel region 26. Hosel region 26 is shown as being located at the intersection of ball striking face 17, heel 24 and crown 18 and may encompass those portions of face 17, heel 24 and crown 18 that lie adjacent to socket 16. Generally, hosel region 26 includes surfaces that provide a smooth merging from socket 16 to ball striking face 17, heel 24, crown 18 and/or sole 28.

Club head 14 may have a generally squared profile along a rear perimeter, when viewed from above, such that it could be described as a "square head." Although not a true square in geometric terms, the rear perimeter profile would be considered substantially square as compared to a more traditional, rounded, club head. It is further to be appreciated by persons of ordinary skill in the art that club head 14 may be provided with a more traditional rounded shape, when viewed from above. The phrase "round head" refers a club head 14 having a generally or substantially rounded profile. Similarly, a club head 14 provided with a generally triangular shaped rear perimeter profile may be referred to as having a "triangular head."

A longitudinal axis or shaft axis 12*a* extending longitudinally down the center of shaft 12 is shown in FIG. 1B. A grip or other handle element (not shown) may be positioned on shaft 12 to provide a golfer with a slip resistant surface with which to grasp golf club shaft 12. Shaft 12 of golf club 10 may be made of various materials that are conventionally known and used in the art and may be attached to club head 14 in any desired manner.

Thus, club head 14 includes a ball striking face 17, a heel 24, a toe 20, a rear 20, a crown 18 and a sole 28. Further, club head 14 has a top-to-bottom height (H), a front-to-rear breadth (B) and a side-to-side length (L).

Figure 2B:
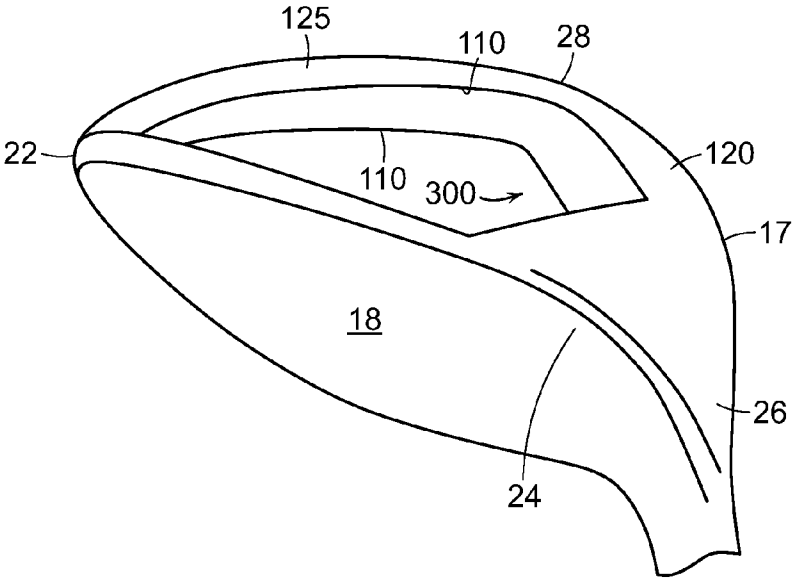
FIG. 2B is a heel-side view of the golf club of FIG. 2A.
Figure 2A:
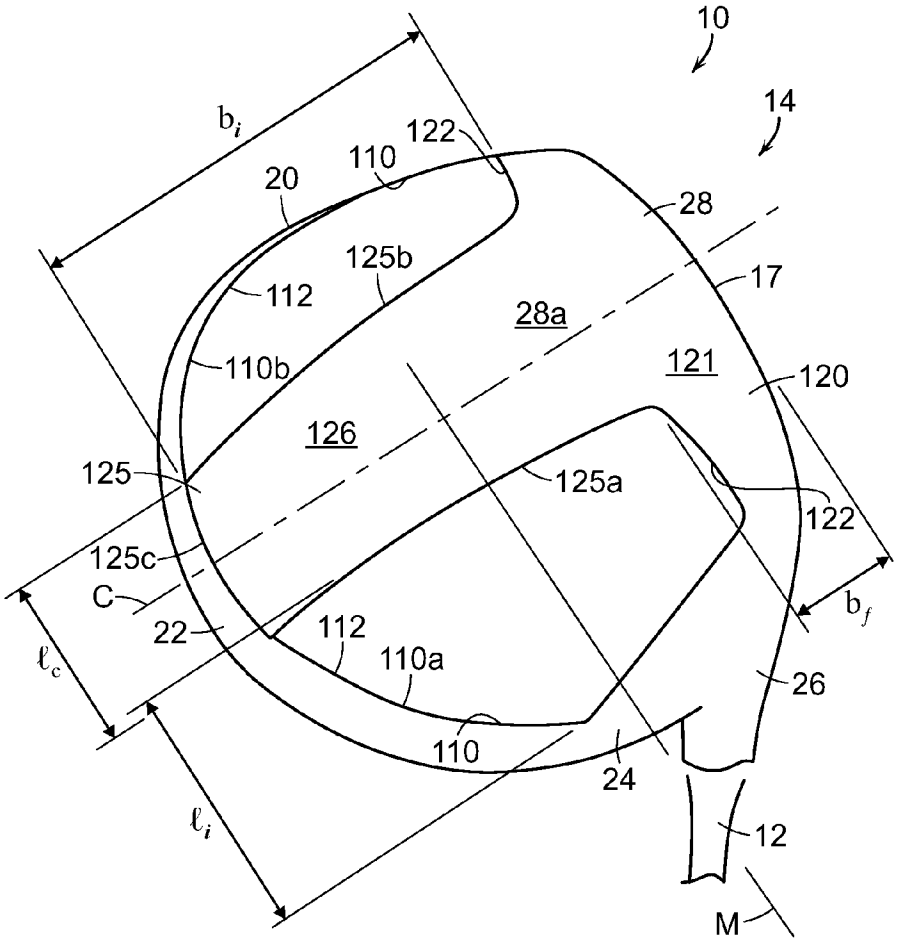
FIG. 2A is a perspective view, generally taken from a heel-side of the sole, of a golf club with insert-receiving features according to certain aspects.

An illustrative embodiment of a metal wood type golf club according to aspects of the invention is shown in FIGS. 2A and 2B. As can generally be seen, sole 28 extends from ball striking face 17 toward rear 22 and from heel 24 to toe 20 of club head 14.

According to certain aspects, sole 28 includes a substantially horizontally-oriented sole surface 28*a* extending rearwardly from ball striking face 17 to the rear 22 of club head 14. Sole 28 may further include a forward sole region 120 which is located adjacent ball striking face 17. Forward sole region 120 extends rearwardly from ball striking face 17 to a rearward edge 122. Rearward edge 122 may extend in a substantially side-to-side length direction. Optionally, rearward edge 122 of the forward sole region 120, when viewed from below, may have a substantially convex profile. Further, forward sole region 120 extends from hosel region 26 and/or heel 24 to toe 20. Generally, forward sole region 120 has a downward facing, relatively horizontally-oriented, forward sole surface 121 that extends from ball striking face 17 to rearward edge 122. This surface 121 may have a shallow curvature, typically, a gently-convex or gently-complex curvature.

The forward sole surface 121 may have a maximum breadth dimension ($b_f$) that is greater than or equal to 15% of the breadth (B) of club head 14, greater than or equal to 20% of the breadth (B), greater than or equal to 25% of the breadth (B), or even greater than or equal to 30% of the breadth (B). Optionally, forward sole surface 121 may have a maximum breadth dimension ($b_f$) that is between 15% to 50% of the breadth (B) of club head 14, between 20% to 50% of the breadth (B), between 25% to 50% of the breadth (B), or even between 30% to 50% of the breadth (B).

According to other aspects, sole 28 may include a central sole region 125, which extends rearwardly from rearward edge 122 of forward sole region 120. Thus, according to certain embodiments, central sole region 125 may extend breadthwise from rearward edge 122 all the way to rear 22. Central sole region 125 has a downward facing, relatively horizontally-oriented, central sole surface 126 bordered by breadthwise-extending edges 125*a*, 125*b*. Surface 126 may have a convex, concave or complex curvature. According to certain embodiments, central sole surface 126 may be substantially planar. Thus, central sole surface 126 may be a relatively flat, plate-like projection that extends rearwardly from rearward edge 122 toward rear 22.

Thus, sole surface 28*a* may include forward sole surface 121 and central sole surface 126. Even further, surface 126 of central sole region 125 may be formed as a continuous surface with surface 121 of forward sole region 120. The surface 126 of central sole region 125 may smoothly merge with surface 121 of forward sole region 120. Optionally, there may be a noticeably change in elevation at the intersection of surface 126 of with surface 121. As shown in the embodiment of FIGS. 2A and 2B, sole surface 28*a* may be substantially T-shaped, with the forward sole surface 121 forming the top portion of the T, and the central sole surface 126 forming the upright portion of the T. Central sole region 125 extends all the way to rear 22 where, in general, it smoothly merges with the rear 22 of club head 14. Alternatively, there may be a noticeably change in elevation at the intersection of surface 126 with rear 22.

According to some aspects, central sole region 125 and central sole surface 126 may be substantially symmetrical with respect to the centerline (C) of club head 14. In other words, central sole region 125 may be substantially centrally located (side-to-side) and edges 125*a*, 125*b* may be substantially symmetrically positioned with respect to the centerline. However, it is to be understood, that central sole region 125 need not be exactly centrally located (i.e., symmetric with respect to the centerline), but may be generally located within a central region (relative to the heel and toe-sides of club head 14) and still be described as being centrally located. For purposes of this disclosure, a central sole region 125 centered within plus or minus 20% of the length of club head 14 to the centerline (C) of club head 14 may be considered centrally located.

Figure 4B:
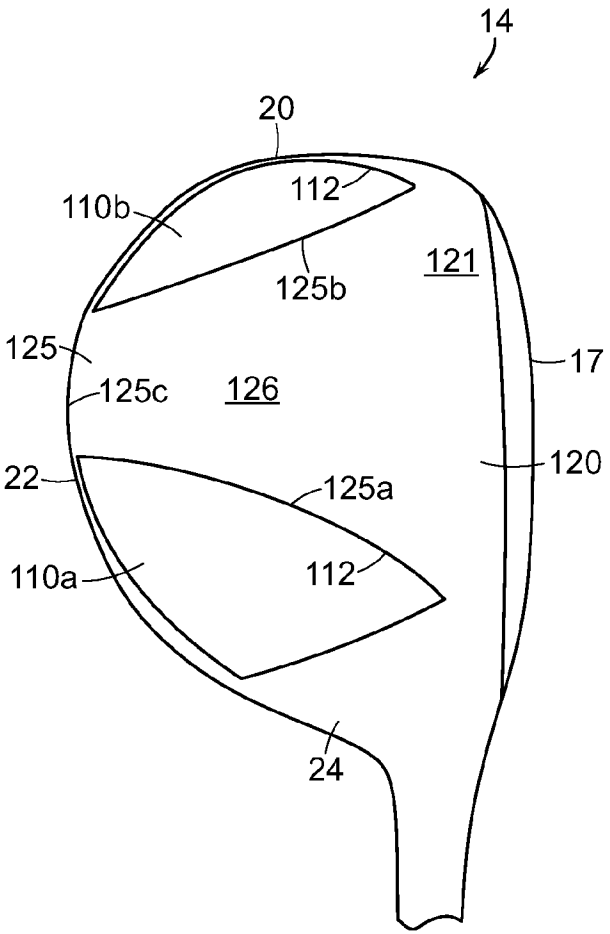
FIG. 4B is a plan view of the sole of a golf club with insert-receiving features according to certain aspects.
Figure 4A:
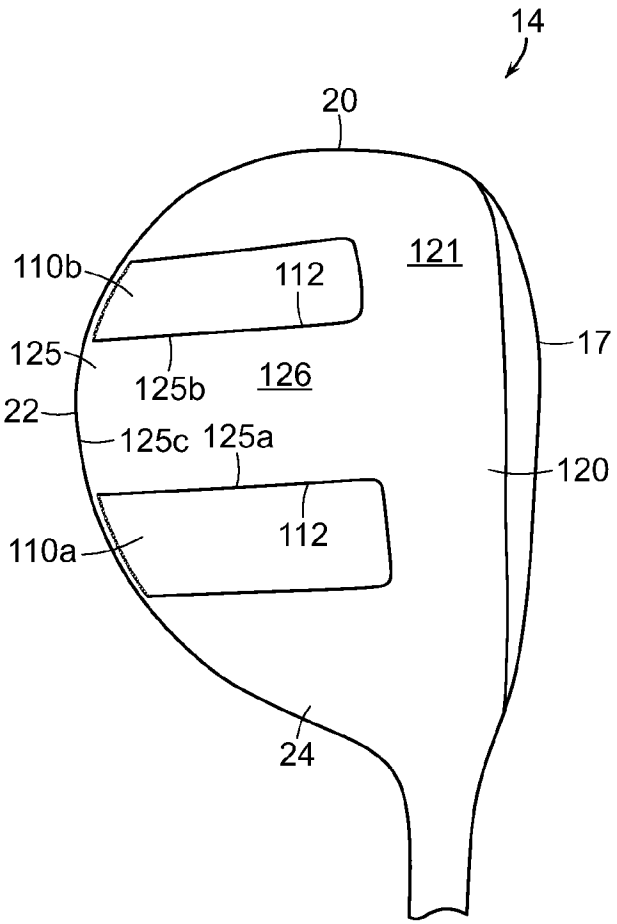
FIG. 4A is a plan view of the sole of a golf club with insert-receiving features according to certain aspects.

As shown in FIG. 2A, central sole region 125 is shaped as a substantially rectangular tang with a slight convergence as it extends toward rear 22. Other example profiles, when viewed from above, of central sole region 125 may include a substantially rectangular shape without any convergence (FIG. 4A), and a substantially triangular shape with a truncated end (FIG. 4B). It is to be understood, that the profile of a central sole region 125 need not be exactly rectangular (or triangular, pyramidal, etc.), but may be generally rectangular and still be described as being substantially rectangular, etc. For example, the generally breadthwise extending edges 125*a*, 125*b* may be and slightly curved sides, either concave or convex.

Referring back to FIG. 2A, central sole surface 126 has a rearmost edge 125*c*. The side-to-side length ($l_c$) of the rearmost edge 125*c* may range from 10% to 40% of the length (L) of the club head 14, from 20% to 40% of the length of the club head, from 20% to 50% of the length of the club head, or even from 20% to 60% of the length of the club head. Further, the profile of rearmost edge 125*c* of central sole surface 126, when viewed from below, may follow the shape of the rear profile of the club head 14. Other profiles for rearward projections, whether regularly-shaped, symmetric, non-symmetric, complexly-curved, etc. would be apparent to persons of ordinary skill in the arts, given the benefit of this disclosure.

According to other aspects of the invention, sole 28 includes one or more insert-receiving features 110. According to certain embodiments, the one or more insert-receiving features 110 may be positioned on either side of central sole region 125. Thus, relative to central sole region 125, a first insert-receiving feature 110*a* may be located toward the heel-side of club head 14. Further, a second insert-receiving feature 110*b* may be located toward the toe-side of club head 14. According to some embodiments, for example as shown in FIGS. 2A and 2B, the first and second insert-receiving features 110*a*, 110*b* may be substantially symmetrically located with respect to the centerline (C) of club head 14. Additionally, the first and second insert-receiving features 110*a*, 110*b* may have substantially mirror-images shapes with respect to the centerline (C).

In the embodiment shown in FIGS. 2A and 2B, the first and second insert-receiving features 110*a*, 110*b* are configured separate and distinct from each other. Also, as shown in this embodiment, the first and second insert-receiving features 110*a*, 110*b* do not extend across the centerline (C) of club head 14.

According to certain aspects, insert-receiving features 110 may be positioned adjacent to and/or alongside central sole region 125. Central sole region 125 may include edges 125*a*, 125*b* extending generally breadthwise from forward sole region 120 toward the rear 22 of club head 14. Additionally, insert-receiving feature 110 may define a perimeter 112. As best shown in FIG. 2A, an edge of perimeter 112 of insert-receiving feature 110 may form an edge 125*a*, 125*b* of central sole surface 125. Further, as also shown in FIG. 2A, an edge of perimeter 112 of insert-receiving feature 110 may form at least a portion of the rearward edge 122 of forward sole surface 120.

According to additional aspects, an insert-receiving feature 110 may extend from rearward edge 122 of forward sole region 120 all the way to rear 22 of club head 14. In certain embodiments, an insert-receiving feature 110 may have a breadth dimension ($b_i$) that is greater than or equal to 30%, greater than or equal to 40%, greater than or equal to 50%, greater than or equal to 60%, or even greater than or equal to 70% of the breadth (B) of club head 14. Thus, an insert-receiving feature 110 may extend over a majority of the breadth (B) of club head 14. Optionally, the breadth dimension ($b_i$) may range from approximately 25% to approximately 60%, from approximately 25% to approximately 70%, or even from approximately 25% to approximately 80% of the breadth (B) of club head 14. Further, an insert-receiving feature 110 may extend across a front-to-rear midline (M) of club head 14. Thus, for example, as shown in FIG. 2A, insert-receiving feature 110 may extend from rearward edge 122 to rear 22, across the front-to-rear midline (M), and over more than 70% of the breadth (B) of club head 14.

According to even other aspects, an insert-receiving feature 110 may have a length dimension ($l_i$) that is greater than or equal to 15% of the length (L) of club head 14. In certain embodiments, an insert-receiving feature 110 may have a length dimension ($l_i$) that is greater than or equal to 20%, greater than or equal to 25%, or even greater than or equal to 30% of the length (L) of club head 14. For certain embodiments, an insert-receiving feature 110 may have a breadth-to-length ratio ($b_i/l_i$) of greater than 1.0, greater than 1.25, greater than 1.5, or even greater than 1.75. For example, as shown in FIG. 2A, insert-receiving feature may have a length dimension ($l_i$) that is greater than 25% of the length (L) of club head 14 with a breadth-to-length ratio ($b_i/l_i$) of greater than 1.5.

According to certain embodiments, insert-receiving feature 110 may have a maximum breadth dimension ($b_i$) of greater than 20 mm, greater than 30 mm, greater than 40 mm, greater than 50 mm, or even greater than 60 mm. Further, insert-receiving feature 110 may have a maximum length dimension ($l_i$) of greater than 20 mm, greater than 30 mm, greater than 40 mm or even greater than 50 mm.

According to some aspects, an insert-receiving feature 110 may have an area, when viewed from below, which is greater than or equal to 15% of the total area of sole 28. In certain embodiments, insert-receiving feature 110 may have an area that is greater than or equal to 20%, greater than or equal to 25%, or even greater than or equal to 30% of the total area of sole 28.

According to other aspects, insert-receiving feature 110 may have a shape that diverges as it extends toward the rear 22 of club head 14. As shown in FIG. 2A, an insert-receiving feature 110 may have a substantially trapezoidal shape, with the top of the trapezoid positioned toward the front of club head 14 and adjacent to forward sole region 120. In this example, insert-receiving feature 110 has a rearward perimeter edge that is curved. Even further, in this example, insert-receiving feature 110 has a rearward perimeter edge that substantially follows the shape of the rear profile of club head 14. The diverging sides of the substantially trapezoidal shape may be curved or linear. In the example of FIG. 2A, the sides are linear. Further, the diverging sides of the substantially trapezoidal shape may be equal or unequal in length. In the example of FIG. 2A, the sides are of unequal length, with the sides closest to the centerline (C) being longer than the sides closest to the outside edges of club head 14. Other diverging shapes for the insert-receiving feature 110, such as triangular, parabolic, egg-shaped, etc., may be provided.

Further, the perimeter 112 of insert-receiving feature 110 need not diverge as it extends toward the rear 22. For example, perimeter 112 may have substantially parallel side edges (see FIG. 4A). Thus, for example, insert-receiving feature 110 may have a substantially rectangular shape. As another example, perimeter 112 may converge as it extends toward the rear (see FIG. 4C). A wide variety of sizes, shapes, positioning and/or relative orientations for the insert-receiving features 110 are possible without departing from this invention.

According to some aspects, and referring back to FIG. 2A, a pair of insert-receiving features 110*a*, 11*b* may be provided one on either side of centerline (C). Insert-receiving features 110*a*, 110*b* may be provided with symmetrical, mirror-image (or substantially symmetrical, mirror-image) perimeters 112 relative to each other. Further, insert-receiving features 110*a*, 110*b* may be positioned approximately equidistant from the centerline (C). Thus, according to certain embodiments, insert-receiving features 110*a*, 110*b* may be provided with symmetrical, mirror-image (or substantially symmetrical, mirror-image) perimeters 112 relative to the centerline (C).

Alternatively, insert-receiving features 110*a*, 110*b* need not be symmetric with respect to the centerline (C) nor need insert-receiving features 110*a*, 110*b* be mirror-images. For example, the insert-receiving feature 110*a* on the heel-side of club head 14 may be smaller than the insert-receiving feature 110*b* on the toe-side. As another example, the insert-receiving feature 110*a* on the heel-side of club head 14 may be substantially triangularly shaped, while the insert-receiving feature 110*b* on the toe-side may be substantially trapezoidally shaped.

Figure 3B:
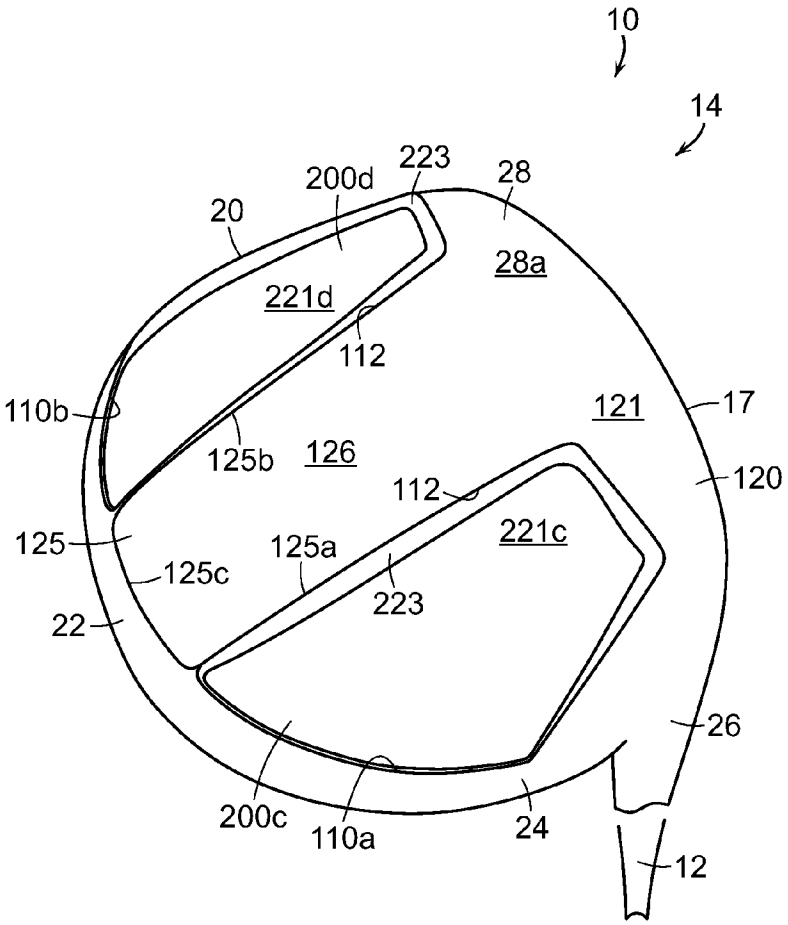
FIG. 3B is a perspective view, generally taken from a heel-side of the sole, of a golf club with inserts according to certain aspects.
Figure 3A:
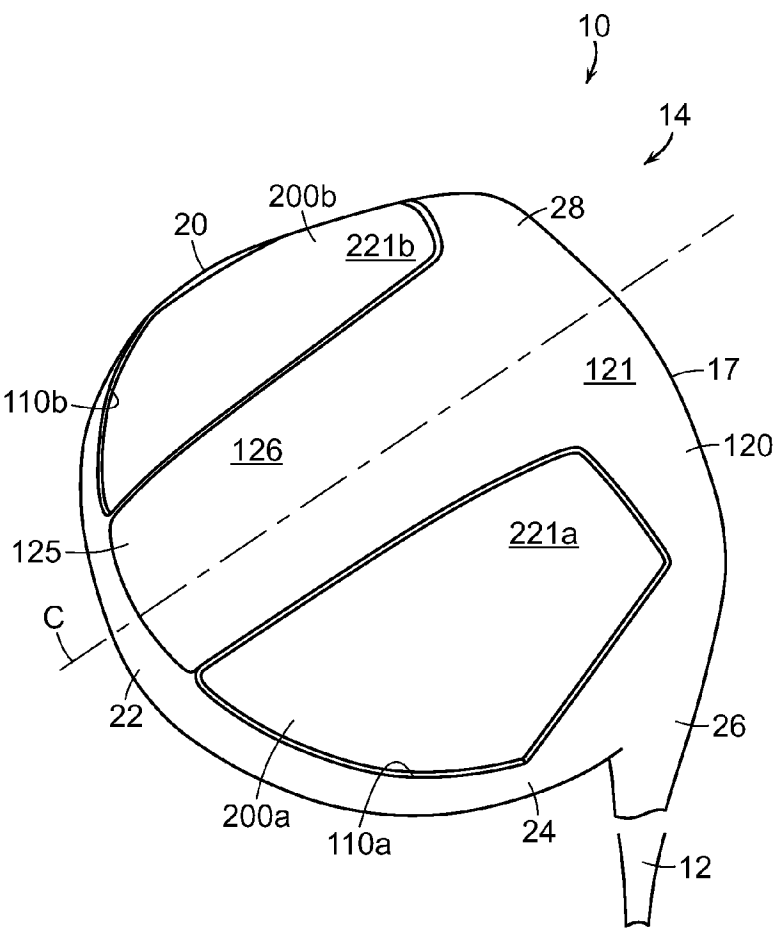
FIG. 3A is a perspective view, generally taken from a heel-side of the sole, of a golf club with inserts according to certain aspects.

According to even further aspects of the invention and referring to FIGS. 3A and 3B, one or more inserts 200 may be positioned within insert-receiving features 110. Even further, according to certain aspects, insert-receiving features 110 may be configured to interchangeably and detachably receive inserts 200, and correspondingly, inserts 200 may be configured to be interchangeably and detachably received within insert-receiving features 110.

The term "detachably attached" refers to an attachment that is designed to be relatively easily undone without damaging the attached parts during the detaching process. The term "releasably joined" may be used interchangeably with "detachably attached." Thus, a detachable attachment would require only nominal forces to detach the parts from one another.

A threaded fastener, which is designed to be readily unscrewed, is an example of a detachable attachment. An elastically deformable snap-lock fitting, which can be unsnapped without being destroyed, so as to allow for two parts to come apart, is another example of a detachable attachment. This is true, even if a special tool is required to unsnap the fitting. An adhesive joint using an adhesive that can be softened or melted at a relatively low temperature, such that the two attached parts slip apart without being damaged, is another example of a detachable attachment.

Thus, a detachable attachment does not cause damage to the parts that are attached to one another when the parts are detached. However, in one embodiment, a detachable attachment could encompass the destruction of an attachment element that is not an element of the parts that are attached. For example, the adhesive element in a releasable adhesive joint may not be capable of being reused and would therefore be considered to be only a single-use, replaceable attachment element (e.g., it may be cleaned off and replaced by fresh adhesive). As another example, two parts could be coupled together with a relatively soft pin that is press fit into relatively hard sockets of the two attached parts. To detach the parts, the pin could be punched out, and in the process destroyed. However, the sockets and the two attached parts would not be damaged. The attachment element, i.e., the pin in this example, is designed to be a single-use, replaceable item.

The opposite of a detachable attachment is a non-detachable attachment. A detachable attachment may be temporary (if it is detached) or permanent (if it is never detached). Thus, if the threaded fastener in the above example is not unscrewed, the two joined parts will remain permanently detachably attached to one other.

A brazed or welded joint would not be considered to be detachable, as detaching the parts would require the application of either excessive, potentially damaging heat, forces or machining to detach the welded elements from one another. Similarly, an adhesive joint that is designed for permanent bonding and that requires the application of excessive, potentially damaging heat to burn the adhesive off or that requires the application of excessive, potentially damaging prying force to pull the joint apart, would not be considered to be detachable. As another example, a riveted joint that generally requires alteration of the joined parts during the riveting process and that further requires unintended destruction of the rivet is not considered to be detachable.

The design context and the context in which the attachment element is used must be taken into account. For example, a threaded fastener with a locking feature that requires considerable force (i.e., potentially damaging the joined parts) to unlock and which was designed to provide a permanent, non-detachable attachment would not be considered to be detachable. However, a threaded fastener having a locking feature that requires only nominal force to overcome and which was selected and designed, for example, to reduce play in the joint, may be considered to be detachable. Such a threaded fastener with a locking feature may be considered to be detachable even if the locking feature and/or the threaded fastener itself is destroyed during detachment.

As used herein, the terms "interchangeable" or "substitutable" refer to items that may be used in place of one another. In general, interchangeable items need not be identical to one another, and the interchangeability will be context driven. Thus, for example, a first component may be attachably interchangeable with a second component in that both the first and the second components may be configured for alternative attachment to a third component. However, the first component may have a different mass, a different center-of-gravity and/or different moments-of-inertia than the second component, and thus, in the context of mass characteristics, the second component would not be interchangeable with the first component. Even further, the second component may be attachably interchangeable with the first component in that both the first and the second components may be alternatively attachable to the third component, even though the details of the attachment might vary.

Interchangeable components are not necessarily detachably interchangeable. For example, two components are attachably interchangeable if each could be attached to a third component in place of the other. However, once the attachment of one of the components is formed with the third component, if the attachment is permanent, then even though the two components were attachably interchangeable, they are not detachably interchangeable. Thus, only if the components are both detachably attachable and interchangeable are they detachably interchangeable.

According to certain aspects of the invention and referring now to FIGS. 3A-3D, one or more interchangeable and/or detachable inserts 200 may be provided for placement within insert-receiving features 110. As shown, inserts 200 may be shaped to complementarily match the perimeter shapes of insert-receiving features 110.

As shown in FIG. 3A, a pair of inserts 200*a*, 200*b* may be positioned on either side of central sole region 125 within insert-receiving features 110*a*, 110*b*, respectively. Inserts 200 may extend from rearward edge 122 of forward sole region 120 to the rear 22 of club head 14. The pair of inserts 200 may be provided with symmetrical, mirror-image (or substantially symmetrical, mirror-image) shapes with respect to the centerline (C) of club head 14. Alternatively, the pair of inserts 200 need not be symmetric nor mirror-images.

According to certain aspects, insert 200 is provided with a surface 221. As shown in FIG. 3A, when inserts 200*a*, 200*b* are located within insert-receiving features 110*a*, 110*b*, surfaces 221*a*, 221*b* may lie flush with surface 121 of forward sole region 120 and/or with surface 126 of central sole region 125.

Optionally, as shown in FIG. 3B, surfaces 221*c*, 221*d* of inserts 200*c*, 200*d* may be offset from sole surface 28*a*. In other words, inserts 200 may have downward facing surfaces 221 that are upwardly offset in the height direction from a downward facing surface 126 of central sole region 125 and/or from downward facing surface 121 of forward sole region 120. In this embodiment, at the rearmost edge of inserts 200*c*, 200*d*, surfaces 221*c*, 221*d* are flush with the surface of rear 22. Still referring to FIG. 3B, insert 200 may have an edge or frame 223 that complements the shape and contour of at least a portion of perimeter 112 of insert-receiving feature 110. Frame 223 may lie flush with perimeter 112.

Figure 3D:
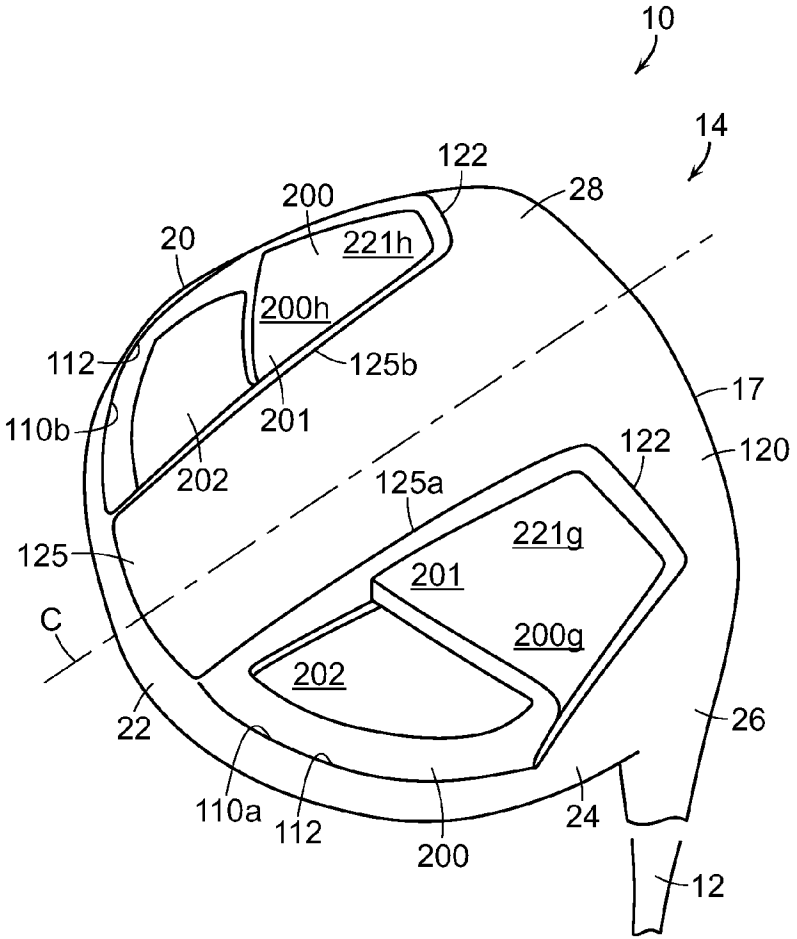
FIG. 3D is a perspective view, generally taken from a heel-side of the sole, of a golf club with inserts according to certain aspects.
Figure 3C:
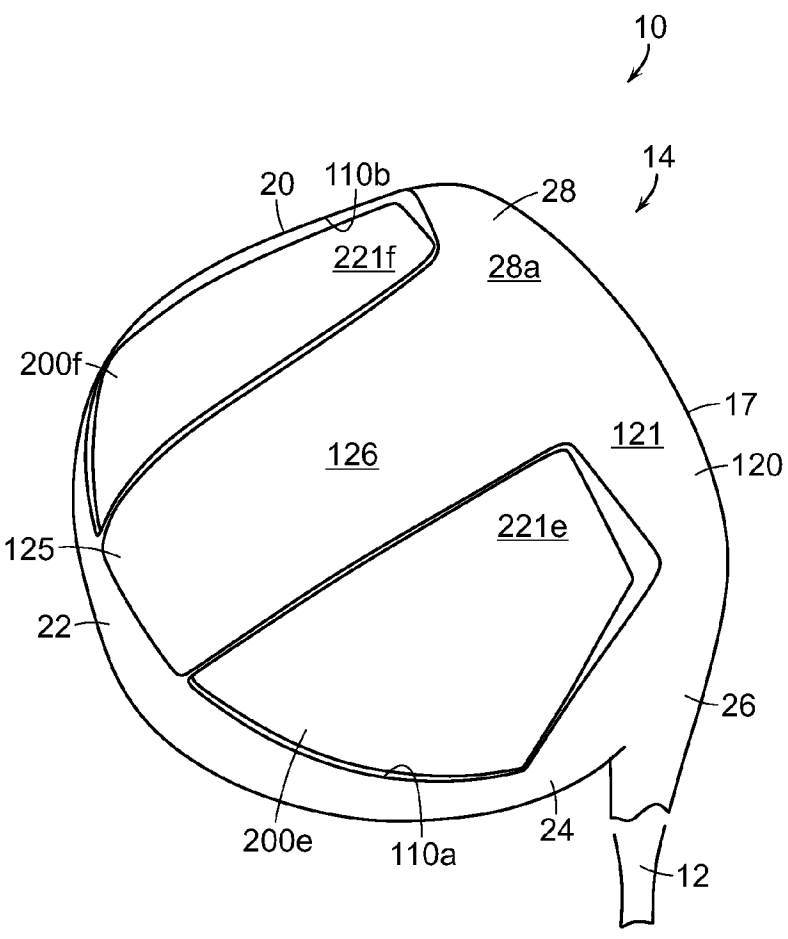
FIG. 3C is a perspective view, generally taken from a heel-side of the sole, of a golf club with inserts according to certain aspects.

Further, according to certain embodiments, insert 200 may be configured such that a portion of surface 221 lies flush with surface 28*a* and a portion is offset from surface 28*a*, when insert 200 is located within insert-receiving feature 110. Referring to FIG. 3C, inserts 200*e*, 200*f* have canted or sloped surfaces 221*e*, 221*f*, such that adjacent to central sole region 125 surfaces 221*e*, 221*f* are flush with central sole surface 126 and adjacent to the sides of club head 14 surfaces 221*e*, 221*f* are offset from surface 28*a*. At the rearmost edge of inserts 200*e*, 200*f*, surfaces 221*e*, 221*f* may be flush with the surface of rear 22. Thus, it is shown that insert 200 may have a sloped surface 221, (i.e., deeper or more offset at a first side and shallower or less offset at an opposite side) relative to surface 28*a* of sole 28.

According to certain aspects, insert 200 may be configured such that surface 221 is offset from both surface 121 of forward sole region 120 and from surface 126 of central sole region 125 when insert 200 is located within insert-receiving feature 110. As another example, referring to FIG. 3D, inserts 200*g*, 200*h* may be positioned within insert-receiving features 110*a*, 110*b* such that surfaces 221*g*, 221*h* having stepped-down or tiered features are offset from surface 121 of forward sole region 120 and from surface 126 of central sole region 125.

Thus, the offset surface 221 of insert 200 may serve to aerodynamically extend forward sole region 120, thereby possibly ameliorating aerodynamic effects that could be caused by abrupt discontinuities, while at the same time providing a reduced ground-contacting surface due to the upwardly offset surfaces.

In some embodiments, as shown in FIGS. 3A-3D, inserts 200 completely fill insert-receiving features 110. Further, inserts 200 may be sized and positionable such that they do not extend beyond the rear profile of club head 14. Even further, inserts 200 may serve to seal or close off insert-receiving features 110, thereby inhibiting or preventing debris from entering the interior of club head 14. A flexible o-ring or other gasket may be assist in sealing or closing off insert-receiving feature 110. In other embodiments, any particular insert 200 may only partially fill an insert-receiving feature 110.

A wide variety of sizes, shapes, positioning, orientations, and/or relative orientations for inserts 200 within insert-receiving feature 110 are possible without departing from this invention. For example, as shown in FIG. 3D, an insert 200 may have a stepped surface 221 including a substantially horizontally-oriented forward deck 201 and a substantially horizontally-oriented rearward deck 202. The rearward deck 202 is heightwise offset upward from the forward deck 201. The forward deck 201 may extend rearwardly below a forward portion of the rearward deck 202, i.e., the forward deck 201 may overlap the rearward deck 202. Both the forward deck 201 and the rearward deck 202 of the insert 200 may be heightwise offset from sole surface 28*a*.

Further, interchangeable inserts 200 may have different configurations and/or masses (and/or may be made of different materials) to enable users and/or club fitters to selectively place additional weight toward the club head's toe or heel areas (e.g., to provide a fade or draw bias to the club head, to help compensate for swing flaws to correct hook or slice ball flights, etc.).

Inserts 200 may include a plastic material, a composite material, a metal, a ceramic and/or any combination thereof. For example, insert 200 may be formed with an injection molded plastic, a compression molded plastic, co-molded plastics, overmolded plastics, etc.

According to some aspects, inserts 200 may have a mass greater than 20 grams, a mass greater than 30 grams, a mass greater than 40 grams, or even a mass greater than 50 grams. According to even other aspects, the mass and/or density of inserts 200 need not be evenly distributed.

Inserts 200 may be engaged with the club head 14 and/or perimeter 112 in a variety of ways without departing from this invention. For example, interchangeable inserts 200 may be secure to club head 14 with friction fits, mechanical connectors, retaining members/groove or opening structures, snap-fit structures, spring-loaded mechanisms, adhesives, etc. For example, insert 200 may have an edge that is positioned underneath a rim of insert-receiving feature 110 and within a channel formed as part of insert-receiving feature 110. Insert 200 may be inserted into insert-receiving feature 110 by sliding insert 200 from the rear of insert-receiving feature 110 toward the front of insert-receiving feature 110.

According to some aspects and referring back to FIG. 2B, club head 14 may be hollow and insert-receiving features 110 may open into a void, recess or cavity feature 300 extending above forward sole region 120 and/or above central sole region 125. In other words, insert-receiving features 110 may be formed as simple cutouts in the sole 28, such that in the absence of any insert 200 being located within insert-receiving feature 110, such a cutout would provide access to the interior cavity 300 of club head 14.

According to certain embodiments, cavity feature 300 may extend above forward sole region 120 (or a portion thereof), but not above, central sole region 125. Alternatively, according to certain embodiments, cavity feature 300 may extend above central sole region 125 (or a portion thereof), but not above, forward sole region 120. According to some embodiments and still referring to FIG. 2B, when cavity feature 300 extends above central sole region 125, or a portion thereof, central sole region 125 may be formed as a shell or bridge-like element.

Figure 4C:
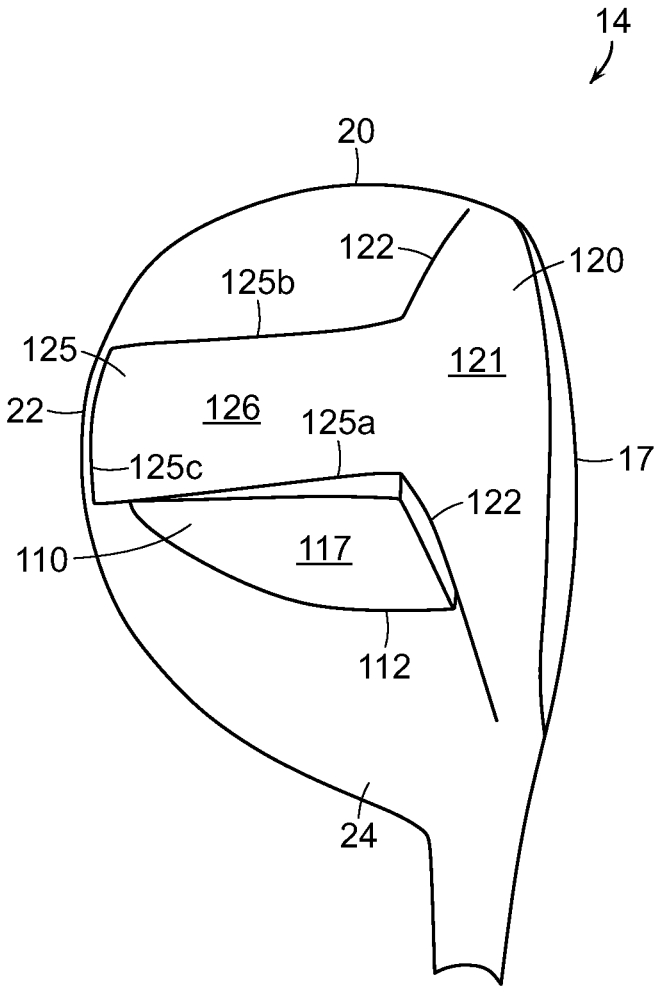
FIG. 4C is a plan view of the sole of a golf club with an insert-receiving feature according to certain aspects.

According to other aspects and referring to FIG. 4C, an insert-receiving feature 110 may be provided with a walled recess 117 or insert cradle, such that any cavity feature or hollow region extending above forward sole region 120 and/or central sole region 125 does not open to the insert-receiving features 110. In other words, walled recesses 117 may have side walls and a floor that may close off any access to the interior of club head 14 that would otherwise be gained via insert-receiving features 110. Walled recesses may be complementarily shaped to receive and retain inserts 200.

According to some aspects and also referring to FIG. 4C, only a single insert-receiving feature 110 is provided in sole 28. Generally, it may be preferable to have two, three, four, or even more insert-receiving features 110 provided in sole 28. However, any number of insert-receiving features 110 may be provided without departing from this invention.

The dimensions and/or other characteristics of golf club head structures according to aspects of this invention may vary significantly without departing from the invention. Thus, according to certain aspects, the club head is a driver and the length and/or the breadth of the club head may be greater than 11.0 cm. For example, the club head breadth (B) may be greater than or equal to approximately 11.5 cm, or even greater than or equal to approximately 12.0 cm. Similarly, by way of one example, the club head length (L) may be greater than or equal to approximately 11.5 cm, or even greater than or equal to approximately 12.0 cm.

According to other aspects, the ratio of the breadth dimension (B) of club head 14 to the length dimension (L) (i.e., ratio "B/L") may be at least 0.9, and in some examples, this ratio may be at least 0.92, at least 0.93, at least 0.94, at least 0.95, at least 0.96, at least 0.97, or even at least 0.98. Further, club head 14 may have any desired volume, including, for example, a volume of at least 200 cc, and in some examples at least 350 cc, at least 400 cc, at least 420 cc, or even at least 450 cc.

It is expected that a club head having inserts 200 will provide a relatively streamlined club head with improved moment-of-inertia (MOI) characteristics. For example, it is expected that the moment-of-inertia (Izz) around a vertical axis associated with the club head's center-of-gravity may be greater than 3100 g-cm$^2$, greater than 3200 g-cm$^2$, or even greater than 3300 g-cm$^2$ for square-head type club heads. Further, it is expected that the moment-of-inertia (Ixx) around a horizontal axis associated with the club head's center-of-gravity may be greater than 5250 g-cm$^2$, greater than 5350 g-cm$^2$, or even greater than 5450 g-cm$^2$ for square-head type club heads. The vertical (z) axis and the horizontal (x) axis are defined with the club head in the 60° lie angle position (see FIGS. 1A and 1B).

Additionally, it is expected that inserts 200 may result in the height of the center of gravity (CG) of club head 14 being less than or equal to approximately 2.0 cm, less than or equal to approximately 1.75 cm, or even less than or equal to approximately 1.5 cm.

In general, aspects of the present invention relate to systems for providing golf club heads, or other ball striking devices, that better control the mass properties of the individual golf club heads, thereby providing greater flexibility and customizability in the design of the overall golf club. Thus, in accordance with at least some aspects and referring to FIG. 5, a golf club head 14 may include a sole 28 having insert-receiving feature 110*a* within which a first insert 200$a_1$ may be detachably attached. Further, according to certain aspects, a second insert 200$a_2$ may be provided which is attachably interchangeable with the first insert 200$a_1$. The mass properties of the second insert 200$a_2$ may differ from the mass properties of the first insert 200$a_1$. Optionally, the shape of the second insert 200$a_2$ may differ from the shape of the first insert 200$a_1$. The surface properties of the second insert 200$a_2$ may differ from the surface properties of the first insert 200$a_1$. The visual properties of the second insert 200$a_2$ may differ from the visual properties of the first insert 200$a_1$. Even further, the positioning of the second insert 200$a_2$ within the insert-receiving feature 110*a* may differ from the positioning of the first insert 200$a_1$ within the insert-receiving feature 110*a*.

Similarly, sole 28 may include a second insert-receiving feature 110*b* within which a first insert 200$b_1$ may be detachably attached. Further, according to certain aspects, a second insert 200$b_2$ may be provided which is attachably interchangeable with the first insert 200$b_1$. The mass properties of the second insert 200$b_2$ may differ from the mass properties of the first insert 200$b_1$. Optionally, the shape of the second insert 200$b_2$ may differ from the shape of the first insert 200$b_1$. The surface properties of the second insert 200$a_2$ may differ from the surface properties of the first insert 200$a_1$. The visual properties of the second insert 200$b_2$ may differ from the visual properties of the first insert 200$b_1$. Even further, the positioning of the second insert 200$b_2$ within the insert-receiving feature 110*b* may differ from the positioning of the first insert 200$b_1$ within the insert-receiving feature 110*b*.

Thus, first inserts 200$a_1$, 200$b_1$ may be detachably attached to sole 28. The second inserts 200$a_2$, 200$b_2$, which are interchangeable with the first inserts 200$a_1$, 200$b_1$, may be detachably attachable or non-detachably attachable to sole 28 of club head 14.

Figure 5:
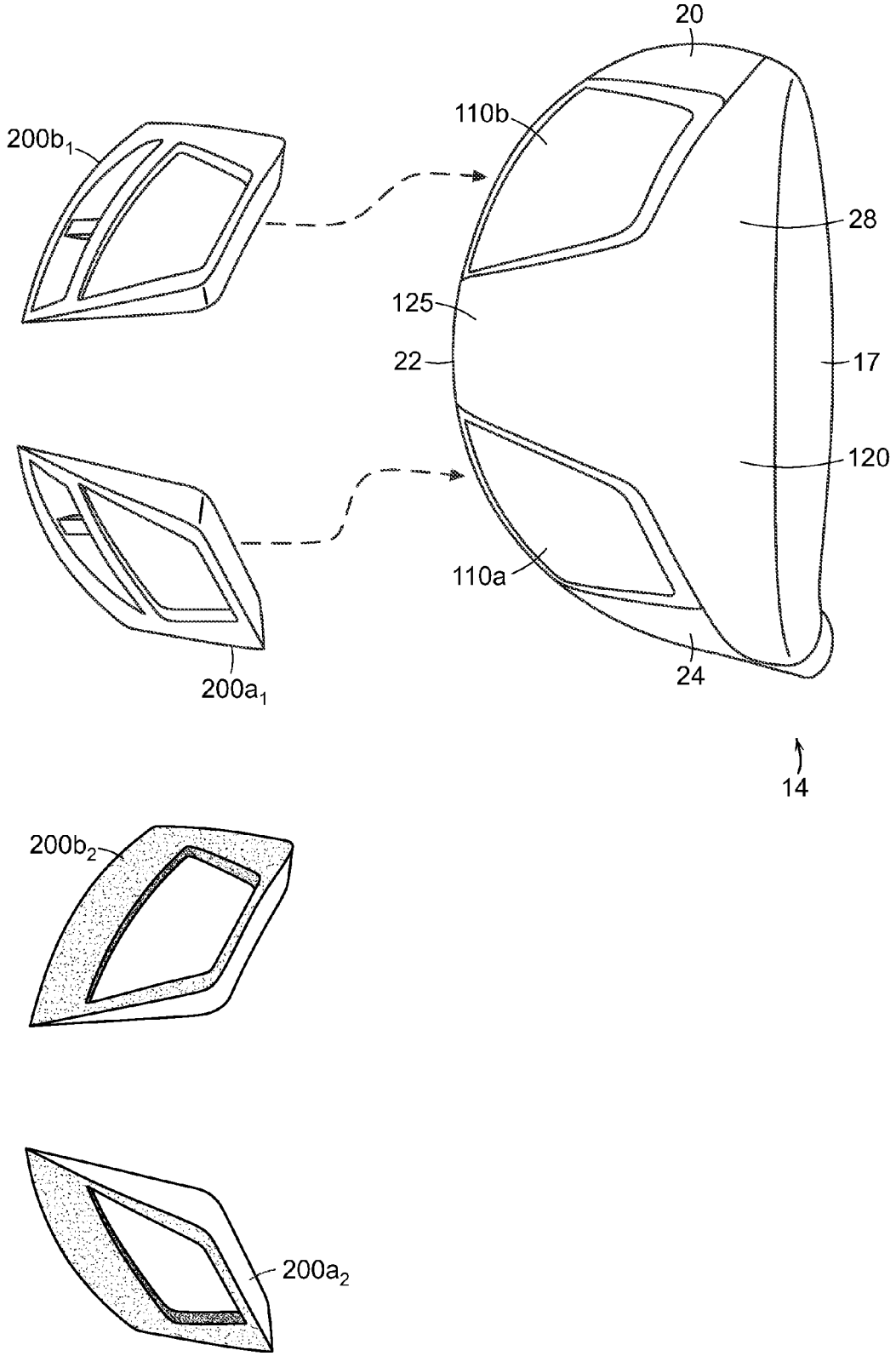
FIG. 5 illustrates a system with a bottom perspective view of the sole of a golf club with insert-receiving features and multiple pairs of inserts for being received by the insert-receiving features according to certain aspects.

Thus, as shown in FIG. 5, in a golf club head system according to an aspect of the invention, one or more inserts 200$a_1$, 200$a_2$, etc. (or pairs of inserts 200$a_1$, 200$b_1$) may be supplied with club head 14 for interchangeable attachment with an insert-receiving feature 110. A first insert 200$a_1$ may be detachably attached to club head 14 and at least one other insert 200$a_2$ that is attachably interchangeable with the first insert 200$a_1$ may be provided. When the first insert 200$a_1$ is detached from club head 14, the other insert 200$a_2$ may be attached to club head 14 in its stead. Thus, either first insert 200$a_1$ or second insert 200$a_2$ may be interchangeably attached to sole 28 of club head 14.

First insert 200$a_1$ has different characteristics from second insert 200$a_2$. For example, first insert 200$a_1$ may have a different configuration, a different center-of-gravity, and/or a different moment-of-inertia characteristic, when compared to second insert 200$a_2$. As other examples, first and second inserts 200$a_1$, 200$a_2$ may be formed of different materials or may have different finishes or looks. Other inserts 200 (not shown) with different characteristics may be provided for interchangeable attachment with club head 14.

The system may be used to provide an additional degree of individual golf club tailoring beyond what would otherwise be obtainable with known systems. For example, a golfer could easily test out multiple golf club head configurations in the shop prior to purchasing a customized club. Further, a golfer could also opt to purchase or take home a set of detachably interchangeable inserts supplied as a kit, thus having the readily available option of transforming or tailoring his or her golf club for different players, for different courses, for different weather conditions, for practicing different swing styles, etc. Retailers could market these easily transformable golf club heads, when sold with more than one detachably interchangeable insert, as a kit, as two-for-one specials, as a cost effective way to own multiple customized club configurations, as a cost effective way to keep up with the latest golf technology by merely updating the interchangeable members, etc.

According to certain aspects, a kit may be provided that includes a golf club head configured for complementarily receiving one or more detachable inserts and a detachable insert. Optionally, a kit may include a golf club head configured for complementarily receiving one or more interchangeable inserts and a plurality of attachably interchangeable inserts. Even further, a kit may include a golf club head configured for complementarily receiving one or more interchangeable inserts and a plurality of attachably interchangeable and detachable inserts. According to even another embodiment, a kit may include a plurality of attachably interchangeable and detachable inserts for use with a complementarily configured golf club head.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a metal wood type club, the club head comprising:

a ball striking face, a heel, a toe, a rear, a crown and a sole, the club head having a centerline extending from the ball striking face to the rear;

the sole including:

a substantially horizontally-oriented sole surface extending rearwardly from the ball striking face to the rear;

a first insert-receiving feature located to a heel-side of the centerline;

a second insert-receiving feature located to a toe-side of the centerline;

wherein the first and second insert-receiving features are substantially symmetrically located with respect to the centerline, wherein the first and second insert-receiving features have substantially mirror-images shapes with respect to the centerline, wherein a first insert is detachably positioned within the first insert-receiving feature, and wherein the first insert has a substantially horizontally-oriented forward deck and a substantially horizontally-oriented rearward deck that is heightwise offset from the forward deck.

2. The golf club head according to claim 1, wherein at least one of the first and second insert-receiving features has a breadth dimension that is greater than or equal to 30% of the breadth of the club head.

3. The golf club head according to claim 1, wherein at least one of the first and second insert-receiving features has a length dimension that is greater than or equal to 25% of the breadth of the club head.

4. The golf club head according to claim 1, wherein at least one of the first and second insert-receiving features has a breadth-to-length dimension of greater than 1.0.

5. The golf club head according to claim 1, wherein at least one of the first and second insert-receiving features has a substantially trapezoidal shape with a rearward edge that follows the shape of the rear profile of the club head.

6. The golf club head according to claim 1, wherein the sole surface includes a forward sole surface adjacent to the ball striking face and a central sole surface, the central sole surface extending from the forward sole surface to the rear of the club head.

7. The golf club head according to claim 6, wherein the central sole surface is substantially symmetrical with respect to the centerline of the club head.

8. The golf club head according to claim 6, wherein the central sole surface converges as it extends from the forward sole surface toward the rear of the club head.

9. The golf club head according to claim 1, wherein the first insert seals the first insert-receiving feature.

10. The golf club head according to claim 1, wherein a rearward portion of the forward deck overlaps a forward portion of the rearward deck.

11. The golf club head according to claim 1, wherein a second insert is detachably positioned within the second insert-receiving feature.

12. A golf club head for a metal wood type club, the club head comprising:

a ball striking face, a heel, a toe, a rear, a crown and a sole, the club head having a centerline extending from the ball striking face to the rear;

the sole including:

a forward sole surface located adjacent the ball striking face and a central sole surface having first and second central sole surface edges extending rearwardly from the forward sole surface, the central sole surface approximately centered over the centerline of the club head;

a first insert-receiving feature located to one of a heel-side or a toe-side of the central sole surface, wherein an edge of the first insert-receiving feature forms at least a portion of the first central sole surface edge; and a first insert detachably positioned within the first insert-receiving feature, wherein the first insert has a substantially horizontally-oriented forward deck and a substantially horizontally-oriented rearward deck that is heightwise offset from the forward deck.

13. The golf club head according to claim 12, wherein the central sole surface has a rearmost edge and the length of the rearmost edge ranges from 20% to 40% of the length of the club head.

14. The golf club head according to claim 12, wherein the first insert-receiving feature defines a cutout providing access to a hollow portion of the club head.

15. The golf club head according to claim 12, wherein the central sole surface and the forward sole surface form a substantially T-shaped sole surface extending rearwardly from the ball striking face to the rear of the club head.

16. The golf club head according to claim 12, wherein the first insert-receiving feature extends from the rearward edge of the forward sole surface to the rear of the club head.

17. The golf club head according to claim 12, sole further comprising:

a second insert-receiving feature located to the other of the heel-side or the toe-side of the central sole surface, wherein an edge of the second insert-receiving feature forms at least a portion of the second central sole surface edge; and a second insert detachably positioned within the second insert-receiving feature.

18. The golf club head according to claim 17, wherein the first insert-receiving feature and the second insert-receiving feature are substantially symmetric, mirror-images of one another.

19. The golf club head according to claim 12, wherein the forward sole surface has a maximum breadth dimension that is between 25% to 50% of the breadth of the club head.

20. The golf club head according to claim 12, wherein the central sole surface has a maximum side-to-side length dimension that ranges from approximately 20% to approximately 60% of the length of the club head.

21. The golf club head according to claim 12, wherein a rearward portion of the forward deck overlaps a forward portion of the rearward deck.

22. A system for a golf club head for a metal wood type club, the system comprising:

a golf club head having a ball striking face, a heel, a toe, a rear, a crown and a sole, the club head having a centerline extending from the ball striking face to the rear;

wherein the sole includes:

a substantially horizontally-oriented sole surface extending rearwardly from the ball striking face to the rear;

a first insert-receiving feature located to a heel-side of the centerline;

a second insert-receiving feature located to a toe-side of the centerline;

wherein the first and second insert-receiving features are substantially symmetrically located with respect to the centerline, and wherein the first and second insert-receiving features have substantially mirror-images shapes with respect to the centerline; and a first plurality of inserts configured for interchangeable attachment within the first insert-receiving feature, wherein the inserts of the first plurality of inserts have masses that differ, wherein a selected insert, from the first plurality of inserts, has a substantially horizontally-oriented forward deck and a substantially horizontally-oriented rearward deck that is heightwise offset from the forward deck.

23. The system for a golf club head according to claim 22, further including a second plurality of inserts configured for interchangeable attachment within the second insert-receiving feature, wherein the inserts of the second plurality of inserts have masses that differ.

24. The system for a golf club head according to claim 22, wherein a maximum breadth dimension of the first insert-receiving feature ranges from 25% to 80% of a breadth dimension of the club head.

25. The system for a golf club head according to claim 22, wherein a maximum length dimension of the first insert-receiving feature ranges from 15% to 40% of the length of the club head.

26. The system for a golf club head according to claim 22, wherein a rearward portion of the forward deck overlaps a forward portion of the rearward deck.

* * * * *